US008076274B2

(12) United States Patent
Scott et al.

(10) Patent No.: US 8,076,274 B2
(45) Date of Patent: Dec. 13, 2011

(54) LUBRICATING OIL COMPOSITION

(75) Inventors: Robin Howard Scott, Abingdon (GB); Robert William Shaw, Abingdon (GB)

(73) Assignee: Infineum International Limited, Oxfordshire (GB)

( * ) Notice: Subject to any disclaimer, the term of this patent is extended or adjusted under 35 U.S.C. 154(b) by 32 days.

(21) Appl. No.: 11/775,246

(22) Filed: Jul. 10, 2007

(65) Prior Publication Data

US 2008/0020951 A1 Jan. 24, 2008

(30) Foreign Application Priority Data

Jul. 20, 2006 (EP) ..... 06117607

(51) Int. Cl.

| | |
|---|---|
| ***C10M 141/12*** | (2006.01) |
| ***C10M 125/24*** | (2006.01) |
| ***C10M 125/22*** | (2006.01) |
| ***C10M 129/00*** | (2006.01) |
| ***C10M 159/00*** | (2006.01) |
| ***C10M 169/04*** | (2006.01) |

(52) U.S. Cl. ..... 508/185; 508/162; 508/370; 508/378; 508/584; 508/154; 508/175; 508/460; 508/586

(58) Field of Classification Search ..... 508/185, 508/192, 198, 370, 378, 584, 162, 154, 175, 508/460, 586

See application file for complete search history.

(56) References Cited

U.S. PATENT DOCUMENTS

| | | | | |
|---|---|---|---|---|
| 6,423,670 | B2 * | 7/2002 | Locke et al. | 508/192 |
| 6,605,572 | B2 * | 8/2003 | Carrick et al. | 508/198 |
| 6,720,293 | B2 * | 4/2004 | Bovington et al. | 508/192 |
| 7,018,958 | B2 * | 3/2006 | Arrowsmith et al. | 508/185 |
| 2001/0036906 | A1 | 11/2001 | Locke et al. | 508/192 |
| 2006/0116299 | A1 | 6/2006 | Arrowsmith et al. | 508/443 |
| 2006/0116300 | A1 | 6/2006 | Arrowsmith et al. | 508/443 |

* cited by examiner

*Primary Examiner* — Michael Marcheschi
*Assistant Examiner* — Chantel Graham

(57) ABSTRACT

A lubricating oil composition for a heavy duty diesel engine comprises a base oil, at least 0.6 mass % of an ash-free antioxidant and an overbased magnesium-containing detergent. The detergent provides greater than 0.05 mass % Mg based on the mass of the composition. Bore polishing in the engine is reduced for a given level of exhaust gas ash production.

13 Claims, No Drawings

LUBRICATING OIL COMPOSITION

This application claims foreign priority benefits under 35 U.S.C. 119(a)-(d) or (f) or 365(b) of EP 06117607.9, filled Jul. 20, 2006.

The present invention relates to a lubricating oil composition, particularly a lubricating oil composition for use in diesel engines (i.e. compression-ignition engines), more especially diesel engines of the type referred to as heavy duty diesel engines, herein abbreviated to "HDD".

Diesel engines comprise one or more bores in each of which a piston reciprocates. The piston has piston rings around its periphery to provide a seal between the combustion chamber and the crankcase. The reciprocating movement of the piston causes the piston rings to bear towards the wall of the bore with the potential to cause wear of the bore wall and the piston rings. Wear of the bore wall and the piston rings is ameliorated by ensuring, as far as possible, that a film of lubricating oil is maintained on the bore wall to avoid or reduce any direct contact between the piston rings and the bore wall.

In certain diesel engines, such as HDDs, the wall of the bore is formed with arrays of grooves which act to retain lubricating oil so that the formation and maintenance of a film of lubricating oil over the wall of the bore is facilitated. The grooves are often formed as spiral grooves or recesses in the bore wall, and these are usually formed as two sets of grooves spiraling in opposite senses in the bore wall so that the grooves of each set overlap each other, whereby the formation and maintenance of a film of lubricating oil on the bore wall is facilitated.

During use of diesel engines, especially HDDs, at least some regions of the bore wall between the grooves become worn, and the depths of the grooves in these regions of the bore wall become correspondingly reduced so that the ability of the grooves to retain lubricant becomes reduced, and this in turn tends to affect adversely the formation and maintenance of the lubricant film between the piston rings and the bore wall, leading to increased wear and possibly to engine failure. The phenomenon of wear of bore regions between grooves is known as "bore polishing".

One objective of the present invention to reduce or eliminate bore polishing by the use of certain types of lubricant, as specified below.

It is well known that lubricant compositions comprising magnesium-containing components tend to cause bore polishing, particularly in contemporary European-style HDDs.

EP 1167497A claims and describes a lubricating oil composition having a sulfur content of 0.01 to 0.3 wt. % and a phosphorus content of 0.01 to 0.1 wt. %, and giving a sulphated ash in the range of 0.1 to 1 wt. %, which comprises a) a major amount of mineral base oil having a sulfur content of at most 0.1 wt, %;

b) an ashless dispersant comprising an alkenyl- or alkylsuccinimide or a derivative thereof in an amount of 0.01 to 0.3 wt. % in terms of a nitrogen atom content;

c) a metal-containing detergent containing an organic acid metal salt which is selected from the group consisting of a non-sulfurized alkali metal or alkaline earth metal salt of an alkylsalicylic acid having a TBN of 10 to 350 mg.KOH/g and a non-sulfurized alkali metal or alkaline earth metal salt of an alkylphenol derivative having a Mannich base structure, in an amount of 0.1 to 1 wt. % in terms of a sulphated ash content;

d) a zinc dialkyldithiophosphate in an amount of 0.01 to 0.1 wt. % in terms of a phosphorus content;

e) an oxidation inhibitor selected from the group consisting of a phenol compound and an amine compound in an amount of 0.01 to 5 wt. %.

The composition of EP 1167497A is intended to provide lubrication for all types of internal combustion engines, including diesel engines, without adversely affecting the functioning of exhaust gas particulate traps, oxidizing catalysts and/or $NO_x$-reducing catalysts. Example 3 of this patent document describes a lubricating oil composition comprising, as a metal-containing detergent, 1.7 wt. % magnesium salicylate which contains 6.0 wt. % Mg, 0.22 wt. % S; TBN 280 mg KOH/g, available as "SAP 008" from Shell Japan Co. Ltd. The magnesium concentration in the lubricating oil composition is 1.7 wt. %×6.0 wt. %=0.102 wt. % Mg. EP1167497A does not appear to relate to heavy duty diesel engines, and is not concerned with bore polishing issues. It does not provide any disclosure or teaching having a bearing on bore polishing.

U.S. Pat. No. 6,423,670 B2 claims and discloses a diesel engine lubricating oil composition comprising a major amount of oil of lubricating viscosity to which has been added: (a) a lubricating oil ashless dispersant which has not more than 0.2 mass % boron; (b) an oil-soluble neutral calcium phenate detergent; (c) an oil-soluble overbased calcium or magnesium sulfonate or mixture thereof present in an amount such that not more than 0.05 magnesium is present in the composition; (d) a metal dihydrocarbyldithiophosphate present in an amount such that the phosphorus content of the composition is from 0.025 to 0.10 mass %; and (e) a phenolic or aminic antioxidant in a minor amount the composition being free of neutral metal detergent, other than the phenate (b).

Example 2 of U.S. Pat. No. 6,423,670 describes two lubricating oils, both comprising 0.256 mass % overbased Mg sulfonate, a borated dispersant, a neutral calcium phenate, a phenol antioxidant, a zinc dihydrocarbyldithiophosphate, and an overbased calcium sulfonate, and one of the oils comprising, in addition, a neutral calcium sulfonate. The oils were evaluated according the procedure of the Daimler Chrysler Sequence IIIE, OM364LA diesel engine test for several characteristics, including bore polish. The oil comprising the neutral calcium sulphonate gave a poor result (5-6%) in terms of Bore Polish results. Similar oils without the neutral calcium sulfonate gave better results even when the overbased Mg sulfonate content was reduced, other factors being equal.

U.S. Pat. No. 5,320,765A claims and discloses a low sulphated ash heavy duty diesel crankcase lubricating oil composition which comprises a major amount of an oil of lubricating viscosity and (A) at least about 2 weight percent of at least one oil soluble ashless dispersant selected from the group consisting of (i) oil soluble salts, amides, imides, oxazolines and esters, and mixtures thereof, of long chain hydrocarbon substituted mono and dicarboxylic acids or their anhydrides or esters; (ii) long chain aliphatic hydrocarbon having a polyamine attached directly thereto; (iii) Mannich condensation products formed by condensing about a molar proportion of long chain hydrocarbon substituted phenol with about 1 to 2.5 moles of formaldehyde and about 0.5 to 2 moles of polyalkylene polyamine; and (iv) Mannich condensation products formed by reacting long chain hydrocarbon substituted aminophenol, to form a long chain hydrocarbon substitute amide or imide-containing phenol intermediate adduct, and condensing about a molar proportion of the long chain hydrocarbon substituted amide- or imide-containing phenol intermediate adduct with about 1 to 2.5 moles of formaldehyde and about 0.5 to 2 moles of polyamine wherein said long chain hydrocarbon group in (i), (ii), (iii) and (iv) is a polymer of a $C_2$ to $C_{10}$ mono-olefin, said polymer having a number average molecular weight of about 1,000 to about 5,000; (B) an antioxidant effective amount of at least one oil soluble antioxidant material; and (C) at least one oil soluble dihydrocarbyl dithiophosphate material, wherein each hydrocarbyl group has, on average, at least 3 carbon atoms; wherein the lubricating oil comprises a total sulphated ash (SASH) level of less than 0.6 weight percent and a SASH weight:ashless dispersant weight ratio of from about 0.01:1 to about 0.2:1.

The compositions of U.S. Pat. No. 5,320,765A are claimed to reduce engine carbon deposits and to reduce rates of lubricating oil consumption. The compositions according to U.S. Pat. No. 5,320,765 A have low ash contents (less than 0.6 weight percent) in order to meet mandatory limitations on ash in engine exhaust gas.

The combustion of fuels in diesel engines, particularly (but by no means exclusively) in HDDs leads to the formation of acidic moieties which can have detrimental effects such as corrosion of parts of the engine and its exhaust system. Lubricating oils for diesel engines are usually formulated to have relatively high basicity (e.g. high total base number, TBN) in order to neutralize acidic moieties and thus reduce corrosion due to acidic moieties. High basicity is usually attained by incorporating basic metal-containing detergents in the lubricating oils. Common basic metal-containing detergents include calcium-based detergents, such as calcium sulfonates. The basicity of metal-containing detergents is often increased by employing overbased detergents, which are well-known to skilled persons and which contain more basic metal moiety than non-overbased detergents.

The amount of basic metal detergent which can be incorporated in a lubricating oil is restricted because the metal of the detergent gives rise to ash materials which adversely affect the operation of engine equipment such as exhaust gas filters and exhaust gas purification catalysts.

Ash materials are assessed by mass. Thus, the mass of ash which is tolerable for an engine and its associated equipment restricts the TBN of the engine oil arising from the basic metal-containing detergents therein. However, for a given TBN, magnesium detergents produce a lower mass of ash than calcium detergents due to the fact that magnesium is lighter than calcium and gives rise to lighter ash.

Engine oil compositions for diesel engines, including HDDs have been formulated with magnesium detergents. A well-known drawback of lubricant compositions comprising magnesium-containing detergents is that they tend to cause bore polishing, particularly (but not exclusively) in contemporary European-style HDDs. Accordingly, the concentration of magnesium in engine oils has tended to be restricted to relatively low values.

The applicant has discovered that lubricating oils containing relatively high concentrations of magnesium from magnesium-containing detergents can be formulated without giving rise to unacceptable levels of bore polishing or unacceptable levels of ash in diesel engines, including HDDs.

As will be apparent, the use of magnesium-containing lubricating compositions gives rise to certain benefits and advantages.

It has also been observed that, in lubricants containing reduced amounts of phosphorus-containing antiwear additive (e.g., ZDDP), salicylate detergents provide an improvement in wear performance relative to sulfonate and phenate detergents in certain industry standard wear tests for European HDD lubricants, specifically the OM611 wear test. Therefore, in one aspect, the detergent component of the claimed lubricating oil compositions may comprise at least one salicylate detergent.

A first aspect of the present invention provides, a lubricating composition for a diesel engine, particularly a heavy duty diesel engine ("HDD"), comprising the following components:

(a) a lubricating oil basestock of lubricating viscosity;

(b) an antioxidant component;

(c) a detergent component;

optionally (d) one or more metal hydrocarbyl dithiophosphate compounds in an amount of from 0.0 to 1.8 mass %; wherein the antioxidant component (b) is selected from one or more ash-free aminic and/or sulfur-free phenolic compounds in an amount of at least 0.6 mass % and up to 3.0 mass % based on the total mass of the lubricating composition; and the detergent component (c) is an overbased magnesium compound having a total base number (TBN) exceeding 350 mg/g KOH selected from one or more magnesium sulfonates, magnesium salicylates, magnesium phenates and which provide the composition with greater than 0.05 mass % Mg based on the mass of the composition and optionally a calcium detergent compound, and wherein the sulfated ash content of the composition is at least 0.6 mass % and not more than 2.0 mass % as determined by ASTM D874.

A second aspect of the present invention provides a method of operating a heavy duty diesel engine which comprises lubricating the engine with a lubricating oil composition according to the first aspect.

A third aspect of the invention provides a method of reducing bore polishing in a heavy duty diesel engine, which method comprises lubricating the engine with a lubricating oil composition according to the first aspect.

The base oil is an oil of lubricating viscosity and may have characteristics in the following ranges. The base oil contains one or more of Groups I, II, III or IV base stocks as defined in API Engine Oil Licensing and Certification System (EOLCS), Industry Services Department, $14^{th}$ edition, December 1996, Addendum 1, Dec. 1998 and ATIEL code. The base oil sulphur content may be between 0.00 and 1.00 wt. % and the KV @100° C. may be from 3.8 $mm^2/s$ to 21.9 $mm^2/s$. More preferably the base oil sulphur content may be from 0.00 to 0.80 wt. % and the KV @100° C. may be from 3.8 $mm^2/s$ to 8.0 $mm^2/s$.

The antioxidant component may be one or more of an amine or an aminic compound and/or a sulfur-free phenol or a sulfur-free phenolic compound. Suitable amines include (but are not restricted to) Irganox L67 and Irganox L57 available from Ciba and Naugalube 438L available from Chemtura. Suitable sulfur-free phenols include (but are not restricted to) Irganox L135 available from Ciba and HITEC 4782 and 4727 available from Afton Chemicals. "Irganox", "Naugalube" and "HITEC" are trade-names.

The one or more antioxidant component comprise at least 0.6 mass % of the lubricating oil composition, based on the total mass of the lubricating oil composition. Suitably the one or more antioxidant components provide at least 0.75 mass % of the lubricating oil compositions based upon the total mass of the lubricating oil composition. The one or more antioxidant components comprise up to 3.0 mass % of the lubricating oil composition based upon the total mass of the lubricating oil composition. The one or more antioxidant components suitably provide up to 2.75 mass % of the lubricating oil composition, based upon the total mass of the lubricating oil composition.

Suitably, the lubricating oil composition comprises only ash-free antioxidant components.

The overbased magnesium compound provides the composition with greater than 0.05 mass % Mg, based upon the mass of the composition. Suitably, the magnesium compound provides the composition with at least 0.06 mass % Mg, based on the mass of the composition. The magnesium compound may provide the composition with at least 0.063 mass % Mg, based upon the mass of the composition. Suitably, the over-based magnesium compound provides the composition with no more than 0.3 mass % Mg, based upon the mass of the composition. The Mg content of the composition is suitably up to 0.15 mass %, based upon the mass of the composition. The composition suitably comprises up to 0.14 mass % Mg from the magnesium compound, based upon the total mass of the composition.

Lubricating compositions according to the invention may have a TBN (total base number as determined by ASTM D2896) of at least 8.0, preferably 9.0 or higher. The maximum TBN is not likely to exceed 20.0, and 15.0 may be regarded as a practical maximum TBN for many compositions.

Lubricating compositions according to the invention may comprise phosphorus moieties. The phosphorus moieties may be antiwear components such as one or more salts of one or more dihydrocarbyldithiophosphoric acids. A typical salt of a dihydrocarbyldithiophosphoric acid employed as an anti-wear component is zinc dihydrocarbyldithiophosphate, ZDDP. The lubricating compositions may comprise phosphorus moieties from other components, such as certain phosphites which may be employed as antiwear components. Phosphorus may be present in the lubricating compositions (e.g. from ZDDP) in amounts up to 2000 ppm by mass. The maximum phosphorus level is preferably lower, e.g. 1400 ppm or less, such as 1200 ppm or 1000 ppm. The minimum phosphorus level is zero, but may be 80 ppm by mass or higher, e.g. 100 ppm. Phosphorus levels in the range of 200 to 800 ppm may be used in lubricating compositions according to the invention. Suitably, the amount of phosphorous provided by the metal hydrocarbyl dithiophosphate is in the range of 0.05 to 0.20 mass %, based on the mass of the composition.

Lubricating compositions according to the present invention may optionally comprise additional additives, including one or more dispersants. The one or more dispersants are suitably nitrogen containing dispersants. The one or more dispersants may provide the lubricating composition with at least 0.07 mass % nitrogen, based upon the mass of the composition. The one or more optional dispersants suitably provide the lubricating oil composition with between 0.07 to 0.25 mass % nitrogen, based upon the mass of the lubricating oil composition.

The sulphated ash content of the lubricating oil composition is at least 0.6 mass %, based upon the mass of the composition. The lubricating oil composition suitably has a sulphated ash content of at least 0.8 mass %, based on the mass of the composition. A lubricating oil composition according to the present invention suitably has a sulphated ash content of no lower than 1.0 mass %. A lubricating oil composition according to the present invention has a sulphated ash content of not more than 2.0 mass % based on the total mass of the composition. A lubricating oil composition according to the present invention may have a sulphated ash content no greater than 1.6 mass %, preferably no greater than 1.5 mass %, and more preferably no greater than 1.2 mass % based on the mass of the composition.

The invention is now further described with reference to some examples.

A number of lubricating oil compositions were formulated, all suitable for lubricating a heavy duty diesel engine. The compositions contained, inter alia, the following components:

(i) base oil
(ii) detergent;
(iii) dispersant
(iv) antioxidant
(v) anti-wear component Some further details of the foregoing components are now provided:

(i) base oil: the base oils were hydrocarbon oil base stocks with a sulphur content of 0.0 to 0.8 wt. %, a Viscosity Index of 95 to 129 and a base blend KV @100° C. of 5 to 7 $mm^2/s$.
(ii) detergents: the detergent components comprised a mixture of calcium sulphonate, calcium phenate, magnesium sulphonate and calcium salicylate. The combined calcium and magnesium content in the lubricating oil was in the range of from 0.18 to 0.36 mass %. All such detergents are commercially available materials from Infineum UK Ltd.
  (a) The magnesium detergent was a magnesium sulfonate with a Mg content of 9.1 mass % and a TBN of 405.
(iii) dispersant: the ashless dispersants were polyisobutylenesuccinic anhydride-polyamine, usually known as PIBSA-PAM type dispersants. The combined N derived from the dispersant in the lubricating oil was 0.06 to 0.12 mass %. Such dispersants are commercially available from Infineum UK Ltd.
(iv) antioxidant: the antioxidant was an aminic component, referred to below as AntiOxidant A, and consisted of Irganox L67 (tradename) available from Ciba and/or Naugalube 438L (tradename) available from Chemtura, and/or a sulfur-free phenolic component, referred to below as AntiOxidant B, consisting of Irganox L135 (tradename) available from Ciba and/or HITEC 4782 (tradename) available from Afton Chemicals. For the purposes of the comparisons below, the concentration in weight % of each is based on 100% active ingredient material.
(v) anti-wear component: the antiwear component was zinc dihydrocarbyldithiophosphate (ZDDP), wherein the hydrocarbyl group(s) had carbon chain lengths of 4 and 8 and included primary and secondary alkyl groups. The ZDDP component used in the Examples had a phosphorous content of 8.0 mass %. This type of anti-wear component is commercially available from various sources.

The compositions also included components which are usually included in HDD lubricant compositions, such as one or more of the following: friction modifier, viscosity modifier, anti-foamant, demulsifier, pour point depressant (inter alia). Since these components are well-known and are not believed to be significant in relation to the bore-polishing benefits of the lubricating compositions of the invention, they will not be further discussed herein.

Lubricant oil compositions suitable for use with HDDs were formulated from the components (i) to (v) mentioned above, together with other well-known lubricant oil components. The oils were formulated in the well-known manner to have viscosity characteristics of 10W-40 or 15W-40. The lubricant viscosity was SAE 40 grade and all samples had an approximately equal kinematic viscosity at 100° C., thereby factoring out base stock effects and giving a robust comparison between the samples. The compositions had varied concentrations of the following components: the calcium and magnesium detergents, the dispersant, the antioxidant and the ZDDP antiwear component.

Samples of the thus formulated compositions were evaluated for bore polish characteristics in accordance with the well-known test: CEC-L-52-T-97 (OM441LA). The test method is available from the CEC (Coordinating European Council).

The results of the tests are shown in Table 1.

TABLE 1

Bore Polish Test Results - (Test Procedure according to CEC-L-52-T-97)

| | Low % Mg, Low AO** PASSING Oil Bore Polish | | | | High % Mg, Low AO** Fail on Bore Polish | | | | High % Mg Oil, High AO** Pass on Bore Polish | | | | | | |
|---|---|---|---|---|---|---|---|---|---|---|---|---|---|---|---|
| | Sample No. | | | | | | | | | | | | | | |
| | 1 | 2 | 3 | 4 | 5 | 6 | 7 | 8 | 9 | 10 | 11 | 12 | 13 | 14 | |
| | Viscosity Grade | | | | | | | | | | | | | | |
| | 10W-40 | 15W-40 | 15W-40 | 15W-40 | 15W-40 | 15W-40 | 15W-40 | 15W-40 | 15W-40 | 15W-40 | 15W-40 | 15W-40 | 15W-40 | 10W-40 | |
| Formulation Summary (mass %) | | | | | | | | | | | | | | | |
| Ca | 0.332 | 0.235 | 0.329 | 0.299 | 0.295 | 0.107 | 0.204 | 0.204 | 0.272 | 0.155 | 0.156 | 0.057 | 0.170 | 0.172 | |
| Mg | 0.026 | 0.026 | 0.029 | 0.053 | 0.056 | 0.075 | 0.102 | 0.102 | 0.053 | 0.065 | 0.066 | 0.134 | 0.138 | 0.074 | |
| P | 0.12 | 0.10 | 0.12 | 0.12 | 0.10 | 0.08 | 0.12 | 0.12 | 0.13 | 0.11 | 0.12 | 0.12 | 0.12 | 0.08 | |
| TBN* | 13.0 | 10.1 | 11.6 | 11.7 | 11.1 | 8.3 | 12.2 | 12.2 | 12.5 | 9.8 | 9.5 | 11.2 | 14.3 | 12.2 | |
| Sulphated Ash** | 1.4 | 1.1 | 1.4 | 1.5 | 1.4 | 0.8 | 1.3 | 1.3 | 1.4 | 1.0 | 1.0 | 1.0 | 1.4 | 1.0 | |
| N derived from Dispersant | 0.096 | 0.084 | 0.105 | 0.085 | 0.061 | 0.078 | 0.105 | 0.105 | 0.117 | 0.108 | 0.108 | 0.108 | 0.124 | 0.106 | |
| AntiOxidant - A | 0.30 | 0.30 | 0.00 | 0.00 | 0.00 | 0.40 | 0.00 | 0.00 | 0.39 | 0.00 | 0.00 | 0.00 | 0.90 | 1.50 | |
| AntiOxidant - B | 0.00 | 0.00 | 0.42 | 0.17 | 0.17 | 0.00 | 0.42 | 0.42 | 0.44 | 1.60 | 1.60 | 1.60 | 1.30 | 1.00 | |
| Total Ashless AO*** | 0.30 | 0.30 | 0.42 | 0.17 | 0.17 | 0.40 | 0.42 | 0.42 | 0.83 | 1.60 | 1.60 | 1.60 | 2.20 | 2.50 | |
| Engine Test CEC-L-52-T-97 (OM441LA) | | | | | | | | | | | | | | | |
| Pass/Fail vs ACEA E7-04 | PASS | PASS | PASS | FAIL | FAIL | FAIL | FAIL | FAIL | PASS | PASS | PASS | PASS | PASS | PASS | LIMIT |
| Bore Polish | 1.1 | 0.2 | 0.6 | 3.6 | 2.7 | 2.4 | 2.6 | 2.9 | 1.4 | 0.5 | 0.0 | 0.5 | 0.3 | 1.1 | 2.0 max |

*TBN refers to Total Base Number in mgKOH/g as measured by ASTM D2896.
**Sulphated Ash as measured by ASTM D874.
***AO = Anti-Oxidant Referring to Table 1, oil samples 1, 2 and 3 are illustrative of compositions having low magnesium contents and low antioxidant contents. The magnesium contents are in the range of 0.26 to 0.29 mass %. The antioxidant contents are in the range of 0.30 to 0.42 mass %. The other components of these three samples are in concentrations which do not significantly affect the Bore Polish test results. A skilled person would know how to adjust the concentrations of the other components to achieve this effect. It is seen that the compositions all have bore polish results below the maximum limit (2.0) and that therefore, all of the samples 1, 2 and 3 pass the Bore Polish test.

Oil samples 4 to 8 are illustrative of compositions having high magnesium contents and low antioxidant concentrations. The samples have Mg concentrations in the range of 0.053 to 0.102 mass %, and antioxidant concentrations in the range 0.17 to 0.42 mass % (overlapping those of Samples 1 to 3). The other components of these five Samples are present in concentrations which do not significantly affect the Bore Polish results. A skilled person would know how to adjust the concentrations of these other components to achieve this effect. It is apparent from the Test Results for Samples 4 to 8 that high Mg concentrations and low antioxidant concentrations produce Bore Polish "Fail" results above the maximum limit (2.0), in the range of 2.4 to 3.6. It is also apparent that "Fail" results were still obtained in the range despite varying the principal anti-wear additive (ZDDP-A) from 0.08 to 0.12 wt. % P.

Reference is now made to the data in Table 1 for Samples 9 to 14. These Samples have high Mg concentrations and high antioxidant concentrations. The Mg concentrations are in the range 0.053 to 0.138 mass % and overlap the Mg concentrations of Samples 4 to 8. The antioxidant concentrations are in the range 0.83 to 2.50 mass %. The other components of these six samples are present in concentrations which do not significantly affect the Bore Polish results. A skilled person would know how to adjust the concentrations of the other components to achieve this effect. It is apparent from the Test Results for Samples 9 to 14 that high Mg concentrations in combination with high antioxidant concentrations produce Bore Polish "Pass" results below the maximum limit of 2.0, and in the range 0.0 to 1.4. This range is similar to the range for Samples 1, 2 and 3 despite the fact that Samples 9 to 14 comprise from about twice to about four times as much Mg. This result is surprising since it has previously been found that lubricating oils containing magnesium tend to have a reduced performance with respect to bore polishing.

Moreover, it is seen from the data in Table 1 that relatively high concentrations of magnesium can be employed in compositions according to the invention (e.g. Samples 9 to 14) without giving rise to unacceptably high or excessively high quantities of sulphated ash. For example, Samples 12 which comprises 0.057 mass % Ca and 0.134 mass % Mg gave rise to 1.0 mass % sulphated ash, lower than the sulphated ash obtained with the low and the high Mg oils of Samples 4, 5, 7 and 8. Sample 13, comprising 0.170 mass % Ca and 0.138 mass % Mg, gave rise to 1.4 mass % sulphated ash, no higher than the ash obtained with low Mg Samples 1 and 3 and high Mg Samples 4 and 5, which all contain relatively higher levels of calcium that Samples 13.

Generally speaking, and as is apparent from Table 1, oil compositions according to the invention provide excellent performance in terms of bore polishing results without giving rise to unacceptable levels of sulphated ash.

What is claimed is:

1. A lubricating oil composition for a diesel engine, comprising the following components:

(a) a lubricating oil basestock of lubricating viscosity;

(b) an antioxidant component;

(c) a detergent component; and optionally (d) one or more metal hydrocarbyl dithiophosphate compounds in an amount of from 0.0 to 1.8 mass % and/or (e) a calcium detergent compound;

wherein the antioxidant component (b) is selected from one or more ash-free aminic and/or sulfur-free phenolic compounds in an amount of at least 0.6 mass % up to 3.0 mass % based on the total mass of the composition; and the detergent component (c) is an overbased magnesium compound having a total base number (TBN) exceeding 350 mg/g KOH selected from one or more magnesium sulfonates, magnesium salicylates, and magnesium phenates and which provide the composition with greater than 0.05 mass % Mg based on the total mass of the composition, and wherein the sulfated ash content of the composition is at least 0.6 mass % to not more than 2.0 mass % as determined by ASTM D874.

2. The composition of claim 1 wherein the Mg content does not exceed 0.3 mass % based on the total mass of the composition.

3. The composition of claim 1 wherein the Mg content is at least 0.06 mass up to 0.15 mass % based on the total mass of the composition.

4. The composition of claim 1 comprising one or more dispersants.

5. The composition of claim 4 wherein the dispersant(s) include one or more nitrogen-containing dispersants.

6. The composition of claim 5 wherein the nitrogen content provided by the nitrogen-containing dispersant(s) is at least 0.07 mass % based on the total mass of the composition.

7. The composition of claim 6 wherein the nitrogen content provided by the nitrogen-containing dispersant(s) is in the range of from 0.07 to 0.25 mass %.

8. The composition of claim 1 wherein the antioxidant component(s) consist of ash-free antioxidant compound.

9. The composition of claim 1 having a sulfated ash content no lower than 0.8 mass %.

10. The composition of claim 9 having a sulfated ash content no lower than 1.0 mass %, and no greater than 1.6 mass %.

11. The composition of claim 10 having a sulfated ash content no lower than 1.0 mass %, and no greater than 1.5 mass %.

12. The composition of claim 1 wherein the amount of phosphorus provided by the metal hydrocarbyl dithiophosphate is in the range of from 0.05 to 0.20 mass % based on the total mass of the composition.

13. The composition of claim 1 wherein the detergent component (c) comprises salicylate detergent.

* * * * *